US005398357A

United States Patent [19]

Foster

[11] Patent Number: 5,398,357

[45] Date of Patent: Mar. 21, 1995

[54] HOSPITAL BED CONVERTIBLE TO CHAIR CONFIGURATION

[75] Inventor: L. Dale Foster, Brookville, Ind.

[73] Assignee: Hill-Rom Company, Inc., Batesville, Ind.

[21] Appl. No.: 72,319

[22] Filed: Jun. 3, 1993

[51] Int. Cl.[6] ..... A61G 7/015; A61G 7/05

[52] U.S. Cl. ..... 5/619; 5/624

[58] Field of Search ..... 5/619, 618, 617, 624, 5/602, 425

[56] References Cited

U.S. PATENT DOCUMENTS

| | | | |
|---|---|---|---|
| 1,398,203 | 11/1921 | Schmidt . | |
| 2,308,592 | 1/1943 | Drexler et al. . | |
| 3,032,059 | 5/1962 | McLeod . | |
| 3,038,174 | 6/1962 | Brown et al. . | |
| 3,210,779 | 10/1965 | Herbold . | |
| 3,281,141 | 10/1966 | Smiley et al. . | |
| 3,593,350 | 7/1971 | Knight et al. . | |
| 4,180,062 | 12/1979 | Alberti et al. | 5/602 |
| 4,227,269 | 10/1980 | Johnston . | |
| 4,639,954 | 2/1987 | Speed . | |
| 4,862,529 | 9/1989 | Peck . | |
| 5,179,744 | 1/1993 | Foster et al. | 5/425 |
| 5,226,187 | 7/1993 | Borders et al. | 5/619 |

*Primary Examiner*—Alexander Grosz
*Attorney, Agent, or Firm*—Wood, Herron & Evans

[57] ABSTRACT

A hospital bed which is convertible to a chair configuration has a serially hinged normally horizontal head panel, seat panel, thigh panel and foot panel. The foot panel has a central section and a wing section longitudinally pivoted on each lateral side of the central section. To convert the horizontal bed to the chair configuration the head panel is pivoted upwardly and the foot panel pivots downwardly between parallel rail members of the bed frame. The hinged intersection of the foot panel and the thigh panel pivots upwardly to support the patient's knees. Through sliding contact with rail members of the bed frame each wing section pivots upwardly in response to the downward movement of the central section of the foot panel. With the foot end of the foot panel pivoted downwardly between the rails of the bed frame and the head end of the foot panel pivoted upwardly to support the patient's knees and the head panel pivoted upwardly to support the patient's back, the hospital bed is converted to a chair configuration.

12 Claims, 3 Drawing Sheets

HOSPITAL BED CONVERTIBLE TO CHAIR CONFIGURATION

FIELD OF THE INVENTION

This invention relates to a hospital bed, and more particularly to a hospital bed that is convertible to a chair configuration.

BACKGROUND OF THE INVENTION

Presently, many patients are confined to their hospital beds for the duration of their treatment. Standard hospital beds provide a sufficiently comfortable support surface for the patients in a supine position.

Frequently though, the patient is interested in either sitting up in bed to be more comfortable or is required by the physician or care provider to elevate from the supine position to an upright sitting position in the course of their treatment. When a patient remains in a supine position for extended periods of time, there is a possibility of detrimental physical consequences. For example, while remaining in the supine position, the patient's circulatory system may not adequately pump blood throughout the patient's entire body. Very often a patient is unable to leave the confines of the hospital bed in order to achieve a sitting position. Therefore, frequently patients are required by their physician or care provider to elevate to a sitting position in order to increase the activity of the circulatory and cardiovascular systems.

In addition to these physical benefits, a patient may want to achieve a sitting position while in his bed for the sake of comfort, reading or watching TV, or meeting with visitors. Very often patients are confined to the hospital bed for long durations and the ability to comfortably sit up is very desirable. One partial solution to this problem, which has proven to be inadequate, is for the patient to prop up his upper torso and back with pillows, blankets or other such materials. While temporarily supporting the patient's back, pillows and the like often shift out of place and offer little or no benefit to the patient's lower body, legs and feet.

Another prior solution to this problem is disclosed in U.S. Pat. No. 4,862,529 directed to a hospital bed and chair configuration and assigned to the assignee of the present invention. That patent discloses a hospital bed which is designed to assist the patient in moving from a supine position to a sitting position for the purpose of achieving a standing or walking position. The bed has a stationary frame which is mounted on a retracting frame which moves relative to the fixed frame and allows the foot end of the bed to drop towards the floor causing a head panel of the bed to rise relative to the fixed frame. While the hospital bed disclosed in that patent allows the patient to exit the bed after going from a supine position to a seated position, it requires the relatively complicated structure of a stationary frame cooperating with a retractable frame to achieve this result. Furthermore, for a patient who wishes to merely achieve a seated position while remaining in the bed, the hospital bed to chair configuration includes additional structure not required when the patient does not exit the bed from the chair position.

SUMMARY OF THE INVENTION

An objective of the present invention has been to provide a hospital bed which is easily convertible to a chair configuration without complicated mechanisms or structures.

A further objective has been to provide a hospital bed which has a narrowed foot end when converted to a chair configuration to facilitate the easy movement and transport of the bed while in the chair configuration.

Still another objective of the present invention has been to provide a hospital bed that converts to a chair while still providing the normal hospital bed articulating functions such as providing for the comfort and protection of the patient situated atop the bed.

These objectives of the present invention are obtained by providing a hospital bed with a deformable mattress atop an underlying support surface. The support surface consists of serially hinged head, seat, thigh, and foot panels which are normally maintained in a horizontal configuration while the patient is situated atop the mattress in a supine position. The foot panel includes a central section and pivotally hinged wing sections laterally positioned on each side of the central section. The patient support panels are mounted on a frame of the hospital bed. When the bed is converted to a chair configuration, the central section of the foot panel drops below and through the bed frame, and the pivotally hinged wing sections on each side of the central section pivot inwardly toward the central section thereby narrowing the foot end of the bed while lowering the foot panel. The portion of the mattress overlying the foot panel is deformable and capable of bending as the wing sections pivot inwardly.

A locking mechanism maintains the foot panel in the horizontal configuration until such time as a nurse or care provider disengages the locking mechanism allowing the foot panel to fall down through the frame in response to both gravity and a downward force applied by the patient's feet. A longitudinal rod underlies the central section of the foot panel and has a collar slidably mounted thereon. A link is pinned to both the collar and the bed frame thereby pivotally connecting the collar to the frame. A spring biased tongue within the collar initially frictionally engages the longitudinal rod thereby locking the collar relative to the rod and maintaining the foot panel in the horizonal configuration. The tongue encircles the rod and is canted relative to the rod thereby frictionally engaging the rod and preventing the collar from sliding there along.

The tongue is connected to a cable which has a pullring accessible to the nurse or care provider. When the pullring is actuated, the cable attached thereto forces the tongue out of frictional engagement with the rod thereby allowing the tongue and collar to slide toward the foot end of the bed along the rod. With the locking mechanism thusly disengaged, the collar slides along the rod allowing the foot panel to pivot downwardly through the frame forcing the wing sections to pivot upwardly and inwardly providing a narrowed hospital bed in the chair configuration.

As the foot panel drops through the frame, the hinged common edge of the foot panel and the thigh panel elevates from the horizontal configuration to support the patient's knees and provide a more comfortable chair configuration. The common edge of the thigh panel and seat panel is likewise hinged thereby permitting the thigh panel to pivot upward in response to the downward movement of the foot panel. The seat panel is fixed relative to the frame thereby providing a seat portion for the chair configuration. The head panel is hinged to the seat panel and is pivoted upwardly as by a hydraulic cylinder or other suitable mechanism well known in the art to provide an inclined support for the back of the patient while the bed is in the chair configuration.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figure 1:
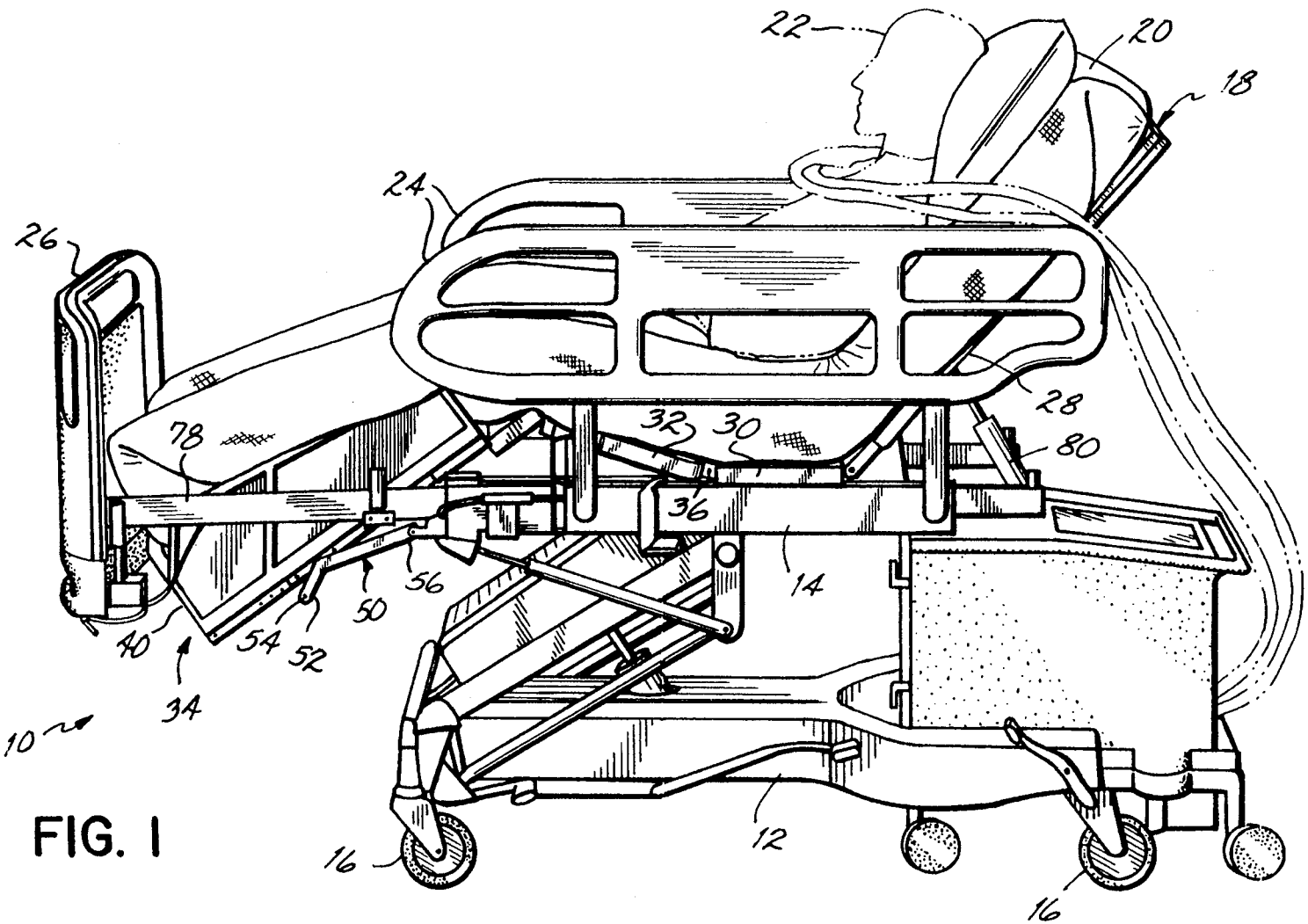
FIG. 1 side elevational view of the hospital bed in the chair configuration according to the present invention.

Referring to FIG. 1, a hospital bed 10 has a base 12 and a frame 14 mounted on the base 12. The hospital bed 10 has casters 16 for movement of the bed 10 about the hospital. The bed 10 has a patient support surface 18 underlying a mattress 20 on which a patient 22 is situated. The hospital bed 10 has patient side guards 24 and foot guards 26 for the protection of the patient 22 situated atop the bed 10.

Figure 2:
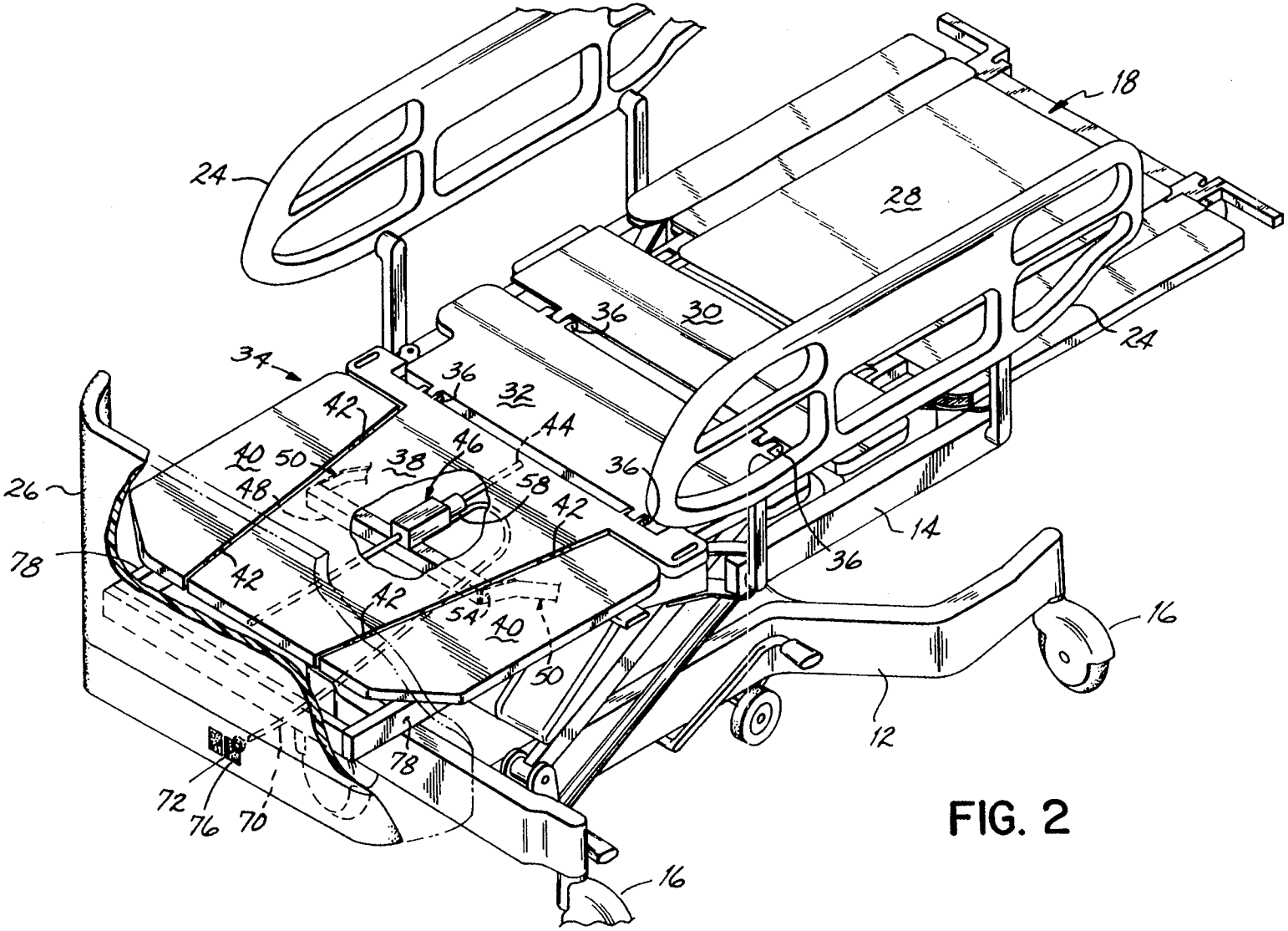
FIG. 2 is a perspective view of the hospital bed in a horizontal configuration.

As shown in FIG. 2, the patient support surface 18 consists of serially hinged head 28, seat 30, thigh 32 and foot panels 34. Each panel is pivotally attached to the adjoining panel by pins 36 or other suitable mechanisms well known in the art. The foot panel 34 consists of a central section 38 and a pair of wing sections 40, 40, one of which is pivotally mounted on each lateral side of the central section 38 as by hinges 42.

Figure 3:
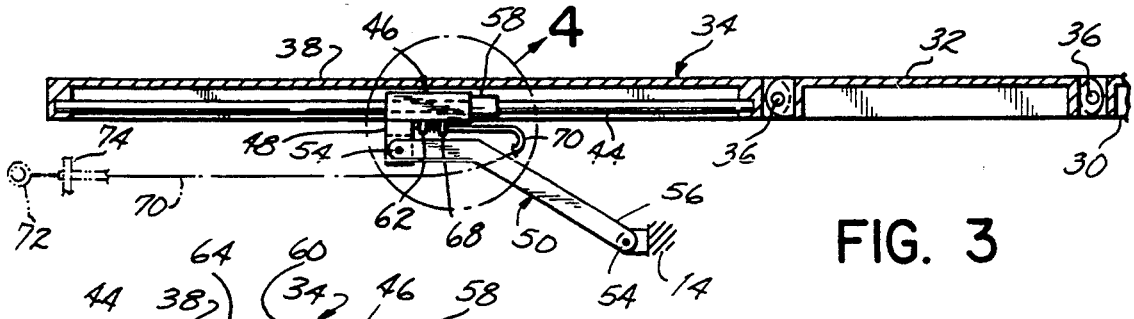
FIG. 3 is a side elevational view of the serially hinged thigh panel and foot panel maintained in the horizontal configuration by the locking mechanism of the present invention.

As shown in the exposed region of the central section 38 of the foot panel 34 in FIG. 2, a longitudinal rod 44 is mounted to the underneath side of the central section 38 of the foot panel 34. A collar 46 is slidably mounted on the longitudinal rod 44. A crossbar 48 is secured to the collar 46 underneath the central section 38 of the foot panel 34. A pair of links 50, 50 are pivotally connected to each end of the crossbar 48. A first end 52 of each link 50 is pivotally attached to each end of the crossbar 48 with a pin 54 and a second end 56 of each link 50 is pivotally attached to the frame 14 of the hospital bed 10 also with a pin 54 as shown in FIG. 3. A stop 58 is secured to the longitudinal rod 44 to restrict the movement of the collar 46 along the rod 44.

Figure 4:
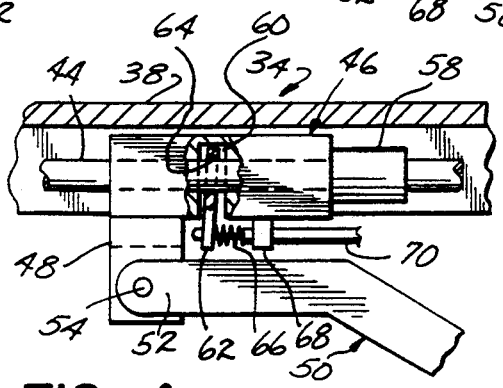
FIG. 4 is an enlarged sectional view of the area of region 4 in FIG. 3.

Mounted within a slot 60 in the collar 46 is a tongue 62 encircling the longitudinal rod 44 with an aperture 64 in the tongue 62 as shown in FIG. 4. The tongue 62 is biased by a spring 66 to be canted relative to the longitudinal rod 44 so that edges of the aperture 64 frictionally engage the rod 44. When in the can ted and locked position, the spring biased tongue 62 prevents the collar 46 from sliding along the longitudinal rod 44. The spring 66 is positioned between the lower end of the tongue 62 and a brace 68 secured to the collar 46. Secured to the lower end of the tongue 62 and extending through both the spring 66 and the brace 68 is a cable 70 for disengaging the tongue 62 from the longitudinal rod 44. An opposite end of the cable 70 is provided with a pullring 72 which is mounted by a brace 74 on the bed frame 14 and is accessible to a nurse or care provider through an opening 76 in the foot guard 26 of the hospital bed 10 as shown in FIG. 2. Also shown in FIG. 2 as part of the bed frame 14, a lateral rail 78 underlies each wing section 40 of the foot panel 34.

In operation, the bed 10 of the present invention typically has the head panel 28, seat panel 30, thigh panel 32 and foot panel 34 in the horizontal configuration as shown in FIG. 2. When in the horizontal configuration, the wing sections 40 are supported by the rails 78 of the bed frame 14. As shown in FIG. 3, the collar 46 is in contact with the stop 58 on the longitudinal rod 44 and the tongue 62 is biased by the spring 66 to be canted relative to the longitudinal rod 44 and in frictional engagement therewith to secure the central section 38 of the foot panel 34 in the horizontal bed configuration.

To convert the bed 10 to the chair configuration, the head panel 28 would be pivoted upward as shown in FIG. 1 by a hydraulic cylinder 80 or other suitable mechanism as is well known by one of ordinary skill in the art. To continue converting the hospital bed 10 to the chair configuration, the pullring 72 attached to the cable 70 and accessible through the foot guard 26 of the hospital bed 10 is pulled by a nurse or care provider. When the pullring 72 is pulled, the cable 70 attached thereto pivots the tongue 62 to thereby compress the spring 66 positioned between the tongue 62 and the brace 68. The tongue 62 pivots to a generally vertical position and out of frictional engagement with the longitudinal rod 44 underlying the central section 38 of the foot panel 34.

Figure 5:
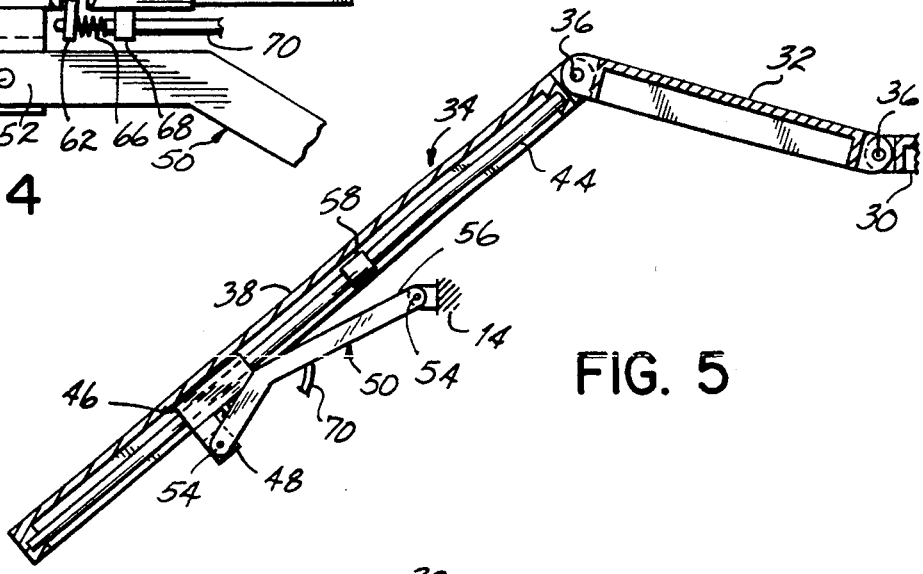
FIG. 5 is a view similar to FIG. 3 with the thigh and foot panels in the chair configuration.
Figure 6:
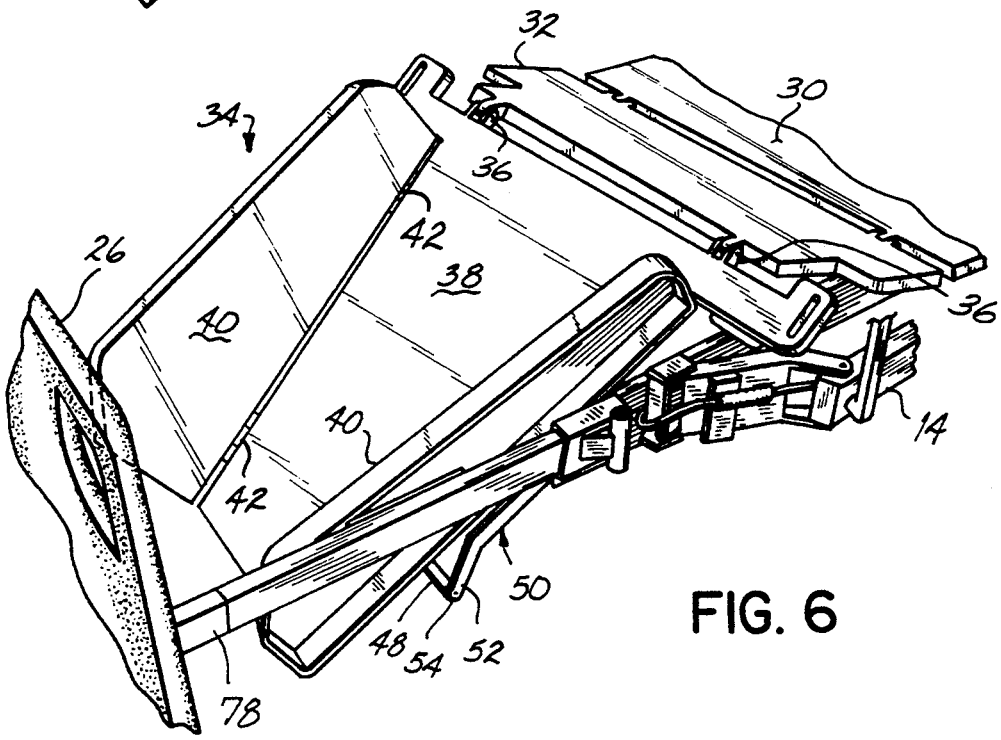
FIG. 6 is a partial perspective view of the hospital bed in the chair configuration.

Once the tongue 62 is no longer canted relative to the longitudinal rod 44, the collar 46 and tongue 62 slide freely along to the longitudinal rod 44. In response to gravity and downward pressure applied by the patient's feet, the foot end of the foot panel 34 drops downwardly through the bed frame 14 between the rails 78 as shown in FIG. 1. As the foot end of the foot panel 34 drops downwardly, the collar 46 slides along the longitudinal rod 44 toward the foot end of the bed 10. In response to the movement of the collar 46 toward the foot end of the bed 10, the links 50 pivot downwardly about the pin 54 securing them to the bed frame 14 as shown in FIG. 5. Likewise, as the foot end of the foot panel 34 drops downwardly through the bed frame 14, the hinged intersection of the foot panel 34 and the thigh panel 32 moves upwardly in response to the collar 46 sliding along the longitudinal rod 44 toward the foot end of the bed 10. Once the central section 38 of the foot panel 34 drops between the rails 78, and the intersection of the foot panel 34 and thigh panel 32 moves upwardly to provide the chair configuration for the hospital bed 10, the pullring 72 is released thereby permitting the spring 66 to expand between the tongue 62 and brace 68. When the spring expands, the tongue 62 is biased to be canted into frictional engagement once again with the longitudinal rod 44.

When the pullring 72 is actuated and the tongue 62 is released from frictional engagement with the rod 44, the foot end of the central section 38 of the foot panel 34 drops below the bed frame 14. Each wing section 40 thereby pivots inwardly toward the central section 38 along the hinged intersection joining each wing section 40 to the central section 38. Each wing section 40 is forced to pivot inwardly toward the central section 38 by sliding contact with the rails 78 of the bed frame 14 positioned underneath each wing section 40.

With the head panel 28 pivoted upwardly and the central section 38 of the foot panel 34 pivoted downwardly between the rails 78 of the bed frame 14, and the wing sections 40 pivoted inwardly toward the central section 38 of the foot panel 34 and the intersection of the foot panel 34 and thigh panel 32 raised upwardly, the hospital bed 10 of the present invention is converted to a chair configuration as shown in FIG. 1. The head panel 28 in an upwardly pivoted position provides back support for the patient 22 situated atop the bed 10. The stationary seat panel 30 provides a comfortable support for the patient's lower back and buttocks region. The patient's thighs are supported in the chair configuration by the upwardly inclined orientation of the thigh panel 32. The intersection of the thigh panel 32 and foot panel 34 is pivoted upwardly in the chair configuration to underlie and support the patient's knees. The foot panel 34 which has dropped between the bed frame rails 78 provides a comfortable place for the patient's lower legs to be downwardly directed in the chair configuration. Additionally, the inwardly folded wing sections 40 provide a comfortable and safe pocket-like section for the patient's legs. With the wing sections 40 pivoted inwardly toward the central section 38 of the foot panel 34, the profile of the hospital bed 10 has been narrowed at the foot end of the bed 10 and the patient's legs are protected by the deformed mattress 20 atop each wing section 40. The protection of the patient's legs and feet and the narrowing of the foot end of the hospital bed 10 is beneficial when transporting the patient 22 on the bed 10 from room to room about the hospital.

To return the hospital bed 10 of the present invention to the horizontal bed configuration, the pullring 72 is again actuated by a nurse or care provider thereby engaging the cable 70 and compressing the spring 66 to pivot the tongue 62 until it is generally perpendicular with respect to the longitudinal rod 44. As such, the tongue 62 no longer frictionally engages the rod 44 and the collar 46 is free to slide there along. The patient 22 may then apply a downward force with his knees along the intersection of the foot panel 34 and the thigh panel 32, coupled with upward force applied to the foot end of the foot section by a care provider, to return the hospital bed 10 to the horizontal configuration. The lowering of the foot panel 34 and thigh panel 32 intersection raises the foot end of the central section 38 of the foot panel 34 above the bed frame 14. The collar 46 translates along the longitudinal rod 44 toward the head end of the foot panel 34 until it abuts against the stop 58 as shown in FIG. 3 at which time the pullring 72 is released and the spring 66 expands to bias the tongue 62 into the canted position shown in FIG. 4 securing the collar 46 relative to the longitudinal rod 44. The stop 58 is provided to prevent the collar 46 from sliding too far toward the head end of the foot panel 34 thereby downwardly pivoting the intersection of the foot panel 34 and the thigh panel 32. The head panel 28 is downwardly pivoted reversing the operation required to raise the head panel 28 as is well known by one of ordinary skill in the art. As the foot panel 34 pivots above the bed frame 14 to return the bed 10 to the horizontal configuration, the wing sections 40 pivot outwardly relative to the central section 38 of the foot panel 34 about the rails 78 of the bed frame 14. The wing sections 40 are forced outwardly in response to the deformed mattress 20 overlying the foot panel 34 returning to its natural, generally planar configuration.

From the above disclosure of the general principles of the present invention and the preceding detailed description of the presently preferred embodiment, those skilled in the art will readily comprehend the various modifications to which the present invention is susceptible.

What is claimed is:

1. A bed convertible to a chair configuration comprising:
   - a base;
   - a frame;
   - linkage mounting said frame to said base;
   - a patient support mounted on said frame and including serially hinged, normally horizontal head, seat, thigh, and foot panels, said foot panel having a central section and a pair of wing sections one of which is pivotally connected to each lateral edge of said central section;
   - means for pivoting said head panel upwardly relative to said frame; and
   - means for moving common edges of said thigh and foot panels upwardly while lowering a foot end of said foot panel and pivoting said wing sections upwardly relative to said central section.

2. The bed of claim 1 wherein said moving means comprises:
   - an elongated rod mounted on an underside of said central section of said foot panel;
   - a collar slidable on said rod;
   - a link pivotally connected at a first link end to said frame and at a second link end to said collar;
   - means for locking said collar relative to said rod;
   - means for selectively disengaging said locking means; and
   - said frame including a lateral rail underlying and supporting each said wing section when said central and wings sections are oriented in a generally horizontal plane;
   - whereby when said disengaging means is actuated said collar slides along said rod toward a foot end of said rod, and forces the common edges of said thigh and said foot panels upwardly while permitting lowering of said foot end of said foot panel, and said lateral rails causing said wing sections to pivot upwardly relative to said central section as said foot end of said foot section lowers.

3. The bed of claim 2 wherein said locking means comprises:
   - a spring biased tongue encircling said rod and canted relative to said rod so as to frictionally engage said rod, said disengaging means permitting said collar to slide along said rod by moving said tongue out of frictional engagement with said rod.

4. The bed of claim 3 wherein said disengaging means comprises:
   - a cable connected on one end to said spring biased tongue; and
   - a pullring connected to the other end of said cable being accessible to and actuatable by a care provider, whereby when said pullring is pulled, said cable moves said spring biased tongue out of frictional engagement with said rod.

5. The bed of claim 4 further comprising:

a stop on said rod restricting movement of said collar on said rod to prevent said foot panel from pivoting upwardly relative to said frame.

6. A bed comprising:

a base;

a frame;

linkage mounting said frame to said base;

a patient support mounted on said frame and including a foot panel having a central section and a pair of wing sections one of which is pivotally mounted on each lateral edge of said central section; and means for lowering a foot end of said foot section while pivoting said wing sections upwardly relative to said central section.

7. The bed of claim 6 wherein said lowering means comprises:

an elongated rod mounted on an underside of said central section of said foot panel;

a collar slidable on said rod;

a link pivotally connected at a first link end to said frame and at a second link end to said collar;

means for locking said collar relative to said rod;

means for selectively disengaging said locking means; and said frame including a lateral rail underlying and supporting each said wing section when said central and wing sections are oriented in a generally horizontally plane;

whereby when said disengaging means is actuated, said collar slides along said rod toward a foot end of said rod and forces a head end of said foot panel upwardly while permitting lowering of said foot end of said foot panel, and said lateral rails causing said wing sections to pivot upwardly relative to said central section as said foot end of said foot section lowers.

8. The bed of claim 7 wherein said locking means comprises a spring biased tongue encircling said rod and canted relative to said rod so as to frictionally engage said rod, said disengaging means permitting said collar to slide along said rod by moving said tongue out of frictional engagement with said rod.

9. The bed of claim 8 wherein said disengaging means comprises:

a cable connected on one end to said spring biased tongue; and a pullring connected to the other end of said cable being accessible to and actuatable by a care provider, whereby when said pullring is pulled, said cable moves said spring biased tongue out of frictional engagement with said rod.

10. The bed of claim 9 further comprising:

a stop on said rod restricting movement of said collar on said rod to prevent said foot panel from pivoting upwardly relative to said frame.

11. A bed convertible to a chair configuration comprising:

a base;

a frame mounted above said base;

a patient support platform mounted on said frame and including serially hinged, normally horizontal head, seat, thigh and foot panels, said foot panel having a central section and a pair of wing sections one of which is located outboard of each lateral edge of said central section and each of which is pivotable relative to said central section;

said head panel being pivotable upwardly relative to said frame;

common edges of said thigh and foot panels being moveable upwardly relative to said frame while lowering a foot end of said foot panel relative to said frame and pivoting said wing sections upwardly relative to said central section.

12. A bed comprising:

a base;

a frame mounted above said base;

a patient support platform mounted on said frame and including a foot panel having a central section and a pair of wing sections one of which is located outboard of each lateral edge of said central section and each of which is pivotable relative to said central section;

a foot end of said foot section being lowerable relative to said frame while said wing sections pivot upwardly relative to said central section.

* * * * *